United States Patent [19]

Kawamoto et al.

[11] Patent Number: 4,724,849

[45] Date of Patent: Feb. 16, 1988

[54] NARROW-CROSS SECTIONED FIBERS FOR USE IN TOBACCO SMOKER FILTERS

[75] Inventors: Junji Kawamoto, Sakai; Atsumu Ohga, Ikoma; Makoto Shiga; Masaharu Takegawa, both of Osaka, all of Japan

[73] Assignee: Daicel Chemical Industries, Ltd., Osaka, Japan

[21] Appl. No.: 908,428

[22] Filed: Sep. 16, 1986

[30] Foreign Application Priority Data

Sep. 20, 1985 [JP] Japan ..... 60-208484

[51] Int. Cl.[4] ..... A24D 3/06

[52] U.S. Cl. ..... 131/345; 106/169; 536/58

[58] Field of Search ..... 131/345; 536/56–58; 106/168, 169

[56] References Cited

U.S. PATENT DOCUMENTS 4,619,279 10/1986 Shiga et al. ..... 131/345

*Primary Examiner*—V. Millin

*Attorney, Agent, or Firm*—Flynn, Thiel, Boutell & Tanis

[57] ABSTRACT

Fibers of narrow cross section for use in tobacco filters composed of cellulose acetate fibers in which the fiber cross section is in a rectangular configuration and the longer/shorter diameter ratio thereof is greater than 5.5.

Filters of high filtering performance can be manufactured with a relatively small fiber filling rate.

7 Claims, 5 Drawing Figures

NARROW-CROSS SECTIONED FIBERS FOR USE IN TOBACCO SMOKER FILTERS

BACKGROUND OF THE INVENTION

1. Field of the Invention

This invention concerns fibers of narrow cross section composed of cellulose acetate and suitable for tobacco smoke filters.

2. Description of the Prior Art

It is well-known that tobacco smoke contains aldehydes such as acetaldehyde, formaldehyde and acrolein, ketones such as acetone, phenolic compounds, alkaloids such as nicotine, organic acids and those materials referred to as tars such as benzopyrene. Tobacco smoke has undesirable effects on smokers' lungs, livers, kidneys and stomachs and, accordingly, it is not good for the smokers' health.

Although there have been various attempts for removing these ingredients, for instance, use of tobacco filters, their effects have not yet been quite satisfactory. That is, conventional tobacco smoke filters comprise tows of cellulose acetate fibers and the cross sectional shape of the filter fibers have progressed from that of the blossom shape referred to as a regular cross section and prepared by spinning through a circular nozzle, into the letter I-cross sectional shape or the letter Y-cross sectional shape, but there have not yet been actually provided tobacco smoke filters that give effective air permeation resistance with a small fiber filling rate and give a satisfactory tar/nicotine removing rate.

SUMMARY OF THE INVENTION

In view of the foregoing present status and demand, the present inventors have made an earnest study on tobacco filters by varying the cross sectional configuration of cellulose acetate fibers in order to obtain those tobacco filters capable of effectively removing tars, nicotine and like other deleterious substances contained in tobacco smoke. As a result, the inventors have found that tobacco filters capable of giving an effective air permeation resistance with a small fiber filling rate and providing a sufficient tar and nicotine removing rate are obtained by making the tobacco filters of fine ribbon-like cellulose acetate fibers of narrow cross section, which fibers are prepared by spinning through a rectangular slit hole having a ratio of longer side/shorter side of greater than 3.5. The fibers have a cross sectional configuration in which both lateral edge portions are enlarged relative to the ribbon-like central portion. The shape is substantially symmetrical with respect to both of the longer and shorter diametrical directions. When the ratio between the lengths measured along the two axes of symmetry, based on the microscopic photograph for the cross section, is defined as the longer diameter/shorter diameter ratio, it has been recognized that the longer diameter/shorter diameter ratio at the fiber cross section is greater than 5.5 if the rectangular slit hole used for spinning has a longer side/shorter side ratio of greater than 3.5. That is, this invention concerns cellulose acetate fibers of narrow cross section for use in tobacco smoke filters in which the fiber cross section is in a rectangular form and the longer diameter/shorter diameter ratio is greater than 5.5.

BRIEF DESCRIPTION OF ACCOMPANYING DRAWINGS

These and other objects, as well as features of this invention will become apparent by the following descriptions of preferred embodiments while referring to the accompanying drawings, wherein FIG. 1 is a schematic view illustrating the cross sectional configuration of a fiber of narrow cross section according to this invention;

Figure 1:
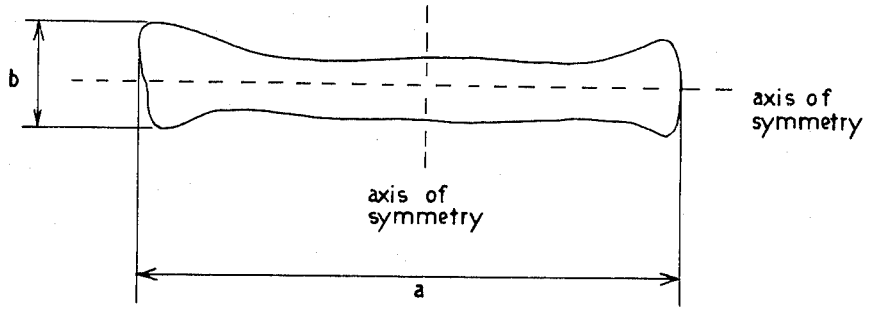
FIG. 1 shows a conceptual view for illustrating the cross sectional configuration of the fibers according to this invention and the longer diameter (a)/shorter diameter (b) ratio thereof.

Although the fibers of I-cross sectional shape described previously for the prior art have also been prepared by spinning from a rectangular nozzle hole, the longer side/shorter side ratio of the slit hole is at most about 1.5 in the case of the I-cross sectional fibers and the longer diameter/shorter diameter ratio at the fiber cross section is smaller than 4.0. Generally, the gas permeation resistance of tobacco filters is dependent on the filling rate of fibers that are packed filters to make the, the surface area of the fibers and the interrupting area of the fibers vertical to the flow of the smoke (projection area to the flowing direction). The cellulose acetate fibers for use in tobacco filters are generally subjected after spinning to crimping of about 15–50/25 mm. The fibers according to this invention are also used while being applied with crimping by using a conventional method, (for instance, an enforcing box type crimping method). Particularly, in the fibers of narrow cross section for use in this invention, since the crimping is mainly applied in the shorter diametrical direction at the cross section, the projection area in the flowing direction of smokes is increased for the fibers of a predetermined weight and, accordingly, a large gas permeation resistance can be developed from an identical filling weight. Since the filtration efficiency of a filter is generally determined by the filter air permeation resistance, it is possible to produce filters that exhibit high filtering performance, with a relatively small fiber charging amount, by using such ribbon-like fibers of narrow-cross section and it is also industrially advantageous from the resource-saving point of view.

The cellulose acetate fibers according to this invention are fabricated into tobacco filters by applying crimping to a tow comprising 30,000 –100,000 continuous fibers each of 0.8 –16 denier gathered together thereby opening the fibers and then wrapping them with some wrapping materials in an ordinary method.

DESCRIPTION OF PREFERRED EMBODIMENTS

This invention will now be explained more specifically by referring to preferred embodiments but it should be noted that this invention is no way limited only thereto.

In the following examples, the air permeation resistance and nicotine and tar removing rates were determined by the following methods as usually employed in the relevant field of the art. The air permeation resistance is shown by the resistance of the filter plug and the tip by aqueous sodium (mmAq) when air is permeated at 17.5 ml/sec.

The tar removing rate and the nicotine removing rate were determined by quantitatively measuring the amounts of nicotine and tar contained in tobacco smokes passing through the filters and the amount of nicotine and tar captured on the filters upon smoking using filter tips by means of liquid chromatography and actual weight measuring method, in which the removing rate ws shown as the ratio captured in the filters.

EXAMPLES AND COMPARATIVE EXAMPLES

An acetone solution of cellulose diacetate was subjected to dry spinning. The solution was spun through a rectangular slit nozzle of 0.100 mm×0.015 mm (longer/shorter side ratio: 4.0) in the example, and spun through a triangle nozzle having 0.075 mm size in Comparative Example 1. Tows having a filament denier of 4.5 d and a total denier of 32,400 were obtained in each of the cases and they were fabricated into a bundle of fibers having 30±3 crimps/25 mm by using an enforcing type crimping machine.

These fiber bundles were subjected to fiber opening and then filter plugs of 102 mm length and 24.7 mm circumferential size wrapped with wrapping paper were obtained by a plug fabricating machine.

Figure 2:
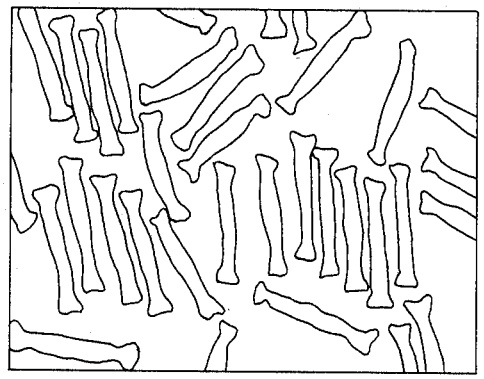
FIG. 2 is a schematic view of microscopic photograph illustrating the cross sectional configuration of fibers of narrow-cross section according to this invention.
Figure 3:
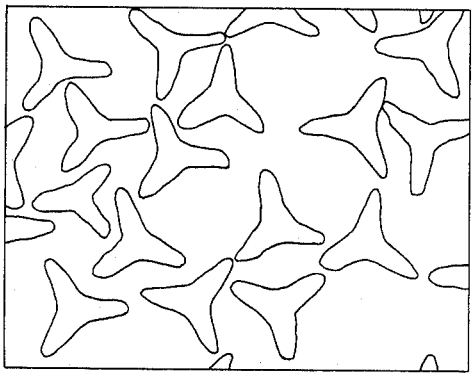
FIG. 3 PRIOR ART
FIG. 3 is a schematic view of a microscopic photograph illustrating the cross sectional configuration of acetate fibers (Y-cross sectioned fibers) used in commercially available filter tips.
Figure 4:
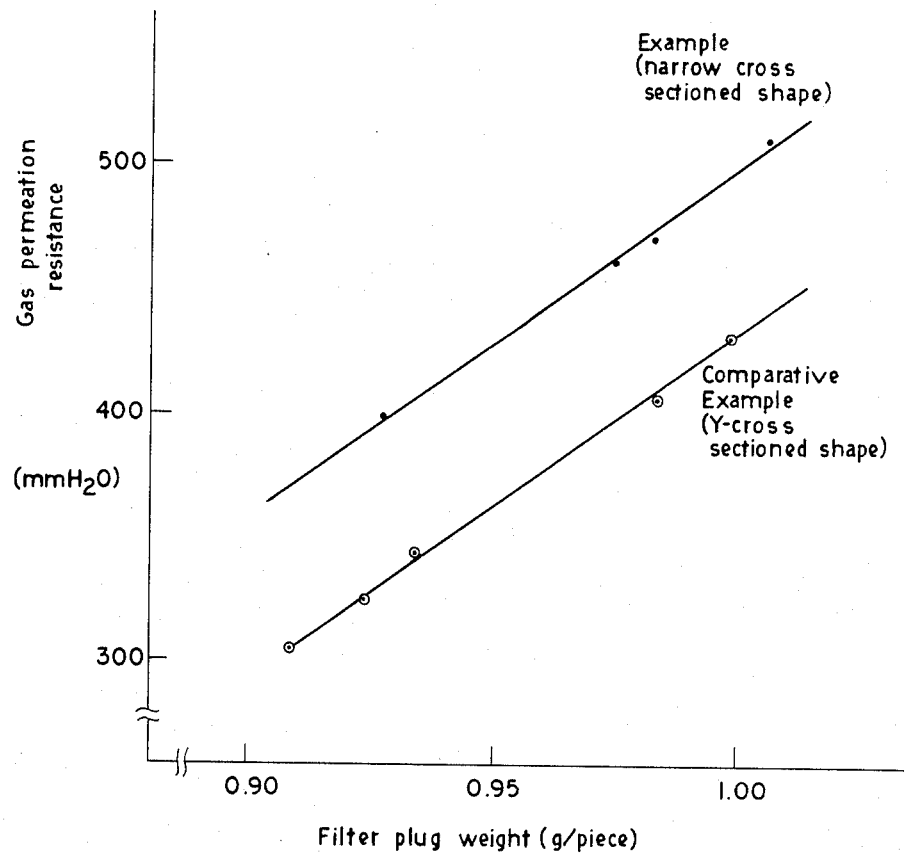
FIG. 4 is a graph showing the relationship between the weight of a filter plug and measured values for the air permeation resistance.

FIG. 2 shows a cross sectional photograph for fibers obtained in the example, while FIG. 3 shows a cross sectional photograph for the fibers obtained in the comparative example. The longer/shorter diameter ratio was 6.54 in the example. The weight and the air permeation resistance were measured for plug specimens with varying filling amounts in examples and comparative examples. The results are shown in Table 1 and FIG. 4.

TABLE 1

| | Filter plug weight (g/piece) | Filter plug air permeation resistance ($mmH_2O$) |
|---|---|---|
| Example (narrow cross sectioned shape) | 0.903 | 397 |
| | 0.928 | 400 |
| | 0.974 | 463 |
| | 0.983 | 472 |
| Comparative, Example (Y-cross sectioned shape) | 0.907 | 306 |
| | 0.934 | 344 |
| | 0.985 | 409 |
| | 0.997 | 452 |

Then, filter tips of 17 mm length were manufactured for each of the filter plugs. The filter portion of commercially available tobacco "Cherry" was removed and, instead, the filter tip as described above was attached to prepare tobacco specimens with filter. The specimens were served for smoking by using a constant volume type automatic tobacco smoking machine made by Filtroner to measure the nicotine removing rate and the tar removing rate by the filter tips. The results are shown in Table 2 together with the measured value for the air permeation resistance and the weight of the filter tips.

TABLE 2

| | Filter tip gas permeation resistance ($mmH_2O$) | Filter tip weight (g/tip) | Tar Tar rate (%) | Nicotine removing rate (%) |
|---|---|---|---|---|
| Example (Narrow cross sectioned shape) | 62 ± 2 | 0.151 | 37 | 30 |
| | 72 ± 2 | 0.159 | 40 | 32 |
| Comparative Example (Y-cross sectioned shape) | 62 ± 2 | 0.159 | 38 | 29 |
| | 72 ± 2 | 0.166 | 41 | 31 |

*The air permeation resistance and the weight of filter tip correspond to 1/6 of the gas permeation resistance and the weight of the filter plug.

Figure 5:
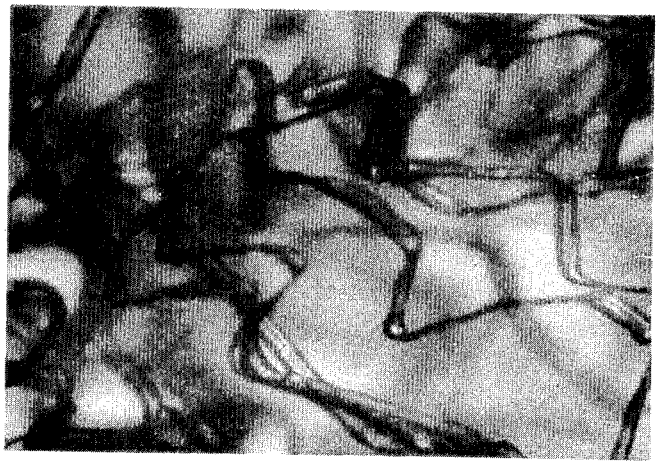
FIG. 5 is a microscopic photograph showing the fibers of narrow cross section according to this invention.

It has been recognized from the foregoing results that the fibers of narrow cross section according to this invention (example) have greater air permeation resistance as well as nicotine and tar removing rates with an identical filling amount as compared with those of Y-cross sectioned fibers manufactured and employed industrially at present (Comparative Example). For the reference, FIG. 5 shows a microscopic photograph for the fibers used in the example as viewed from the side.

What is claimed is:

1. A tobacco smoke filter comprising cellulose acetate ribbon filaments having a narrow, substantially rectangular cross-section defined by two, opposed, wide surfaces and two, opposed, narrow edges respectively connecting corresponding ends of said wide surfaces, the ratio of the cross-sectional length of said wide surfaces to the cross-sectional length of said edges being not smaller than 5.5.

2. A tobacco smoke filter as claimed in claim 1 in which said filament have been prepared by spinning cellulose acetate through a nozzle having a rectangular slit-form opening having a ratio of longer side/shorter side of greater than 3.5.

3. A tobacco smoke filter as claimed in claim 1 in which said filaments are crimped filaments having a filament size of from 0.8 to 16 deniers.

4. A tobacco smoke filter as claimed in claim 3 in which said filaments have from 15 to 50 crimps per 25 mm.

5. A tobacco smoke filter as claimed in claim 1 in which the cross-sectional thickness of the lateral end portions of the cross-section of said filament is larger than the thickness of the central portion of the cross-section of said filament between said lateral end portions.

6. A cellulose acetate ribbon filament having a narrow, substantially rectangular cross-section defined by two, opposed, wide surfaces and two, opposed, narrow edges respectively connecting corresponding ends of said wide surfaces, the ratio of the cross-sectional length of said wide surfaces to the cross-sectional length of said edges being not smaller than 5.5.

7. A cellulose acetate ribbon filament as claimed in claim 6 in which the cross-sectional thickness of the lateral end portions of the cross-section of said filament is larger than the thickness of the central portion of the cross-section of said filament between said lateral end portions.

* * * * *